US005985407A

United States Patent [19]

Murasaki

[11] Patent Number: 5,985,407

[45] Date of Patent: Nov. 16, 1999

[54] MOLDED SURFACE FASTENER WITH BACKING AND METHOD OF MANUFACTURING THE SAME

[75] Inventor: Ryuichi Murasaki, Toyama-ken, Japan

[73] Assignee: YKK Corporation, Tokyo, Japan

[21] Appl. No.: 08/861,578

[22] Filed: May 22, 1997

[30] Foreign Application Priority Data

May 23, 1996 [JP] Japan ..... 8-128674

[51] Int. Cl.[6] ..... B32B 3/06; A44B 21/00

[52] U.S. Cl. ..... 428/100; 428/198; 24/444

[58] Field of Search ..... 428/100, 198; 24/444

[56] References Cited

U.S. PATENT DOCUMENTS

| | | | |
|---|---|---|---|
| 4,643,932 | 2/1987 | Daniels | 428/100 |
| 4,822,443 | 4/1989 | Dubowik | 156/379.7 |
| 4,933,224 | 6/1990 | Hatch | 428/100 |
| 4,999,067 | 3/1991 | Erb et al. | 156/73.1 |
| 5,260,015 | 11/1993 | Kennedy et al. | 264/167 |
| 5,441,687 | 8/1995 | Murasaki et al. | 264/167 |
| 5,763,041 | 6/1998 | Leak et al. | 428/198 |

*Primary Examiner*—Alexander Thomas
*Attorney, Agent, or Firm*—Hill & Simpson

[57] ABSTRACT

In production of a molded surface fastener with backing, molten resin is extruded to the surface of a die wheel, which has in the surface a multiplicity of engaging-element-forming cavities and, at the same time, the cavities are filled with the molten resin. During that time, the die wheel is rotated to continuously mold a multiplicity of engaging elements on the front surface of the substrate sheet. Meanwhile, the backing sheet is pressed against the rear surface of the substrate sheet on the die wheel by a pressing roller to integrally join the backing sheet and the substrate sheet together at a selected pattern of regions.

7 Claims, 9 Drawing Sheets

MOLDED SURFACE FASTENER WITH BACKING AND METHOD OF MANUFACTURING THE SAME

BACKGROUND OF THE INVENTION

1. Field of the Invention

This invention relates to a surface fastener molded of thermoplastic resin and having a multiplicity of engaging elements on the front surface of a substrate sheet and a backing sheet integrally joined with the rear surface of the substrate sheet, and also to a method of continuously manufacturing such molded surface fastener. More particularly, the invention relates to a molded surface fastener which secures adequate flexibility and effectively prevents any crack in a substrate sheet and which is firmly supported by a backing sheet to enable a wide variety of applications, and also to a method of effectively manufacturing such molded surface fastener.

2. Description of the Related Art

A molded surface fastener of the described type is known in which a multiplicity of engaging elements is molded on the front surface of a substrate sheet and a backing sheet is integrally joined with the rear surface of the substrate sheet by pressing the backing sheet against the substrate sheet in a semi-molten state. This known art is exemplified by Japanese Utility Model Publication No. Sho 55-55602. In this publication, fiber material such as a knit or a woven fiber fabric, a non-woven cloth, a paper sheet are fused on the rear surface of a molded surface fastener in which a multiplicity of hook elements are integrally molded on the front surface of a substrate sheet. This publication merely shows the idea of pressing the fiber material against the substrate sheet while it is in semi-molten state but is totally silent about a concrete method for manufacturing such molded surface fastener.

Methods for manufacturing such molded surface fastener are disclosed in, for example, U.S. Pat. Nos. 5,260,015 and 5,441,687. According to these U.S. Patents, while molten resin is introduced to the circumferential surface of a rotating die wheel, which has a multiplicity of engaging-element-forming cavities on the circumferential surface, to continuously mold on the wheel surface a substrate sheet and a multiplicity of engaging elements standing on the front surface of the substrate sheet, a backing sheet is integrally joined with the rear surface of the substrate sheet by pressing the backing sheet against the substrate sheet in semi-molten state by a pressing roller or other pressing means.

However, in the molded surface fastener disclosed in the above-mentioned publications, since the circumferential surface of the pressing roller, which presses the backing sheet against the substrate sheet, is flat entirely, the backing sheet is joined integrally with the entire rear surface of the substrate sheet. As is understood from a common knowledge that the joint surface, which is produced between the substrate sheet and the backing sheet would be rigid, the molded surface fastener with backing described above is very rigid throughout its entire surface and is therefore not suitable for modern molded surface fasteners to which an increased degree of flexibility is required.

Applications of this type molded surface fasteners, with or without backing, in various industrial fields are on the increase in recent years. For example, they are popular as fasteners for various kinds of bags, clothing, and other daily goods as well as for disposable diapers, interior ornaments, and various kinds of industrial materials such as sheet materials and machine parts. Molded surface fasteners to be used in various industrial fields should vary in characteristics to meet with a wide variety of demands. For use in disposable diapers, the molded fasteners should be excellent in softness and small in size but require a limited durability enough for repeated attaching operations two or three times. On the other hand, for use in fastening industrial materials, they require adequate rigidity and excellent engaging toughness and should have such a structure that the materials can be fastened surely by only a single fastening operation.

Flexible manufacturing is therefore inevitable to manufacture such molded surface fasteners different in size and shape to meet with various kinds of demands for functions.

For use in fastening interior ornaments in a car, mere variation of size and shape does not meet with the demands; for example, the molded surface fastener itself should be formed complementarily with a curved wall surface of a car in order to fasten an interior ornament on the wall. Further, on occasions, it is needed to tentatively attach the molded surface fastener to a tentative-attachment member. If the tentative-attachment member is made of magnetic metal such as iron, it is necessary to magnetize the molded surface fastener.

For providing the molded surface fastener with such function, merely changing the size and/or shape does not suffice. None of the conventional molded surface fasteners including those disclosed in the above-mentioned publications do satisfy all the foregoing demands.

SUMMARY OF THE INVENTION

It is therefore a first object of this invention to provide a molded surface fastener in which a backing sheet, such as a knit or woven fabric, a non-woven cloth, a paper sheet or a synthetic resin sheet, is joined with the rear surface of a substrate sheet to make the surface fastener adequately flexible and also to avoid any crack in the substrate sheet, thus meeting demands for a wide variety of applications; and it is a second object of this invention to provide a method of manufacturing such molded surface fastener. According to a first aspect of the invention the above-mentioned first object is accomplished by a molded surface fastener comprising: a synthetic resin molded substrate sheet having a multiplicity of engaging elements molded on a front surface of the substrate sheet; and a backing sheet covering over a rear surface of the substrate sheet and partially integrally joined with the substrate sheet. Preferably, the backing sheet and the substrate sheet are integrally joined by a multiplicity of joining spot regions, a grid-like joining region, at least one straight line of joining region or at least one meandering line of joining region.

With the molded surface fastener of the first aspect of the invention, since the backing sheet is integrally joined with part of the rear surface of the synthetic resin molded substrate sheet rather than with the entire rear surface, it is possible to secure adequate flexibility and also to avoid any crack in the substrate sheet, which would have occurred with the conventional molded surface fastener. Alternatively, the backing sheet may have on its front surface a multiplicity of hooks or pile so that the resulting molded surface fastener can be used as a double-sided molded surface fastener.

In an alternative form, at least one metallic thin strip or wire may be inserted through the space defined between two or more straight lines of joining regions so that the molded surface fastener can hold a desired bent or cured posture when it is bent. This alternative molded surface fastener can be tightly attached to a wall having a complex curved surface, thus making it possible to attach an interior ornament or other thing to the wall neatly without locally floating. In another alternative form, at least one magnetic rubber strip may be inserted through the space between the two or more straight joining regions as a substitute for the thin metal strip or wire so that attaching of the molded surface fastener is facilitated particularly when it is used on metal such as a steel post or inside of various kinds of molding dies, which require precise positioning and presecuring.

The technology of joining a backing sheet with the rear surface of a substrate sheet, which has a multiplicity of engaging elements molded on the front surface, by pressing simultaneously with the molding of the engaging elements on the substrate sheet is already known by, for example, U.S. Pat. Nos. 5,260,015 and 5,441,687. The molding method disclosed in U.S. Pat. No. 5,441,687 comprises the steps of: rotating a die wheel composed of a large number of die rings placed one over another in a drum; supplying molten thermoplastic resin to the circumferential surface of the drum and, at the same time, filling a multiplicity of hook-forming cavities of the drum surface with the molten resin to mold a desired thickness of substrate sheet having a multiplicity of hooks standing on the front surface; merging a backing sheet of suitable material with the substrate sheet on the drum surface to integrally join the backing sheet with the entire rear surface of the substrate sheet; and removing the molded substrate sheet and the molded hooks from the drum surface together with the backing sheet in timed relation with the rotation of the drum while cooling. Each die ring has a large number of hook-shape cavities arranged around the peripheral edge on each side at uniform distances and individually extending radially inwardly of the ring. This individual die ring is sandwiched between adjacent spacer rings which are flat on opposite sides.

According to a second aspect of the invention, the above-mentioned second object is accomplished by a method of continuously manufacturing a molded surface fastener composed of a synthetic resin molded substrate sheet, which has a multiplicity of engaging elements molded on a front surface, and a backing sheet attached to a rear surface of the substrate sheet. The above method is characterized by comprising the steps of: rotating a die wheel, which has in its circumferential surface a multiplicity of engaging-element-forming cavities, in one direction; extruding molten resin to the circumferential surface of the die wheel by a predetermined width from an extrusion nozzle, which is disposed in confronting relationship with the die wheel with a predetermined space, and, at the same time, filling the engaging-element-forming cavities with the molten resin; continuously molding the substrate sheet with the multiplicity of engaging elements molded on the front surface while the die wheel is continuously rotated in a direction in which the molten resin is extruded; continuously merging the backing sheet with the rear surface of the molded substrate sheet at the circumferential surface of the die wheel; and pressing a front surface of the backing sheet at predetermined regions by pressing means to weld the backing sheet with the rear surface of the substrate sheet at the predetermined regions.

Preferably, the backing sheet is previously heated prior to merging with the substrate sheet so that the backing sheet and the substrate sheet can be joined firmly without causing the substrate sheet to became solidified. Further, the pressing means is a pressing roller having on its circumferential surface a predetermined pattern of raised land and rotatable in response to the traveling of the backing sheet to press the backing sheet against the substrate sheet at said predetermined regions by the raised land. The pattern of raised land may be in the shape of spots, a grid (i.e., many straight lines crossing one another in a checkerboard pattern), at least one straight line, or at least one meandering line. Although the individual engaging element to be molded on the front surface of the substrate sheet has a hook shape most practically, it may be a mushroom shape, a palm-tree shape or any of various other shapes.

In the molding method of this invention, utilizing the molding principles of the above-mentioned conventional molding machine, it is possible to secure a desired degree of flexibility meeting individually with demands for a wide variety of applications by a single simple process and to avoid any crack in the substrate sheet. Also it is possible to continuously manufacturing a high-quality molded surface fastener with a backing sheet at high efficiency. Therefore uniform quality of product and improved rate of production as well as lower price of product can be realized at the same time.

DETAILED DESCRIPTION OF THE PREFERRED EMBODIMENTS

Various preferred embodiments of this invention will now be described in detail with reference to the accompanying drawings.

FIGS. 1 through 5 are fragmentary front perspective views of various preferred embodiments, respectively, of a molded surface fastener equipped with a backing sheet (hereinafter also called the molded surface fastener), each showing the manner in which the backing sheet 3 is joined with a substrate set 4*a*; each of these views, hatched sections are joining regions AP at which the backing sheet 3 and the substrate sheet 4*a* are joined.

The thermoplastic synthetic resin material of a molded body 4 composed of the substrate sheet 4*a* and a multiplicity of engaging elements 4*b* is exemplified by nylon, polyester, polypropylene and polyethylene. Each of the engaging elements 4*b* may be an ordinary male engaging element having a hook shape, a mushroom shape or a palm-tree shape, or may be a unique male engaging element having a substantially V shape, for example. The material of the backing sheet 3 may be the same as that of the molded body 4 or natural fibers. The backing sheet 3 may be a woven or knit fabric, a non-woven cloth, a net, a synthetic resin film, or a synthetic resin sheet.

Figure 1:
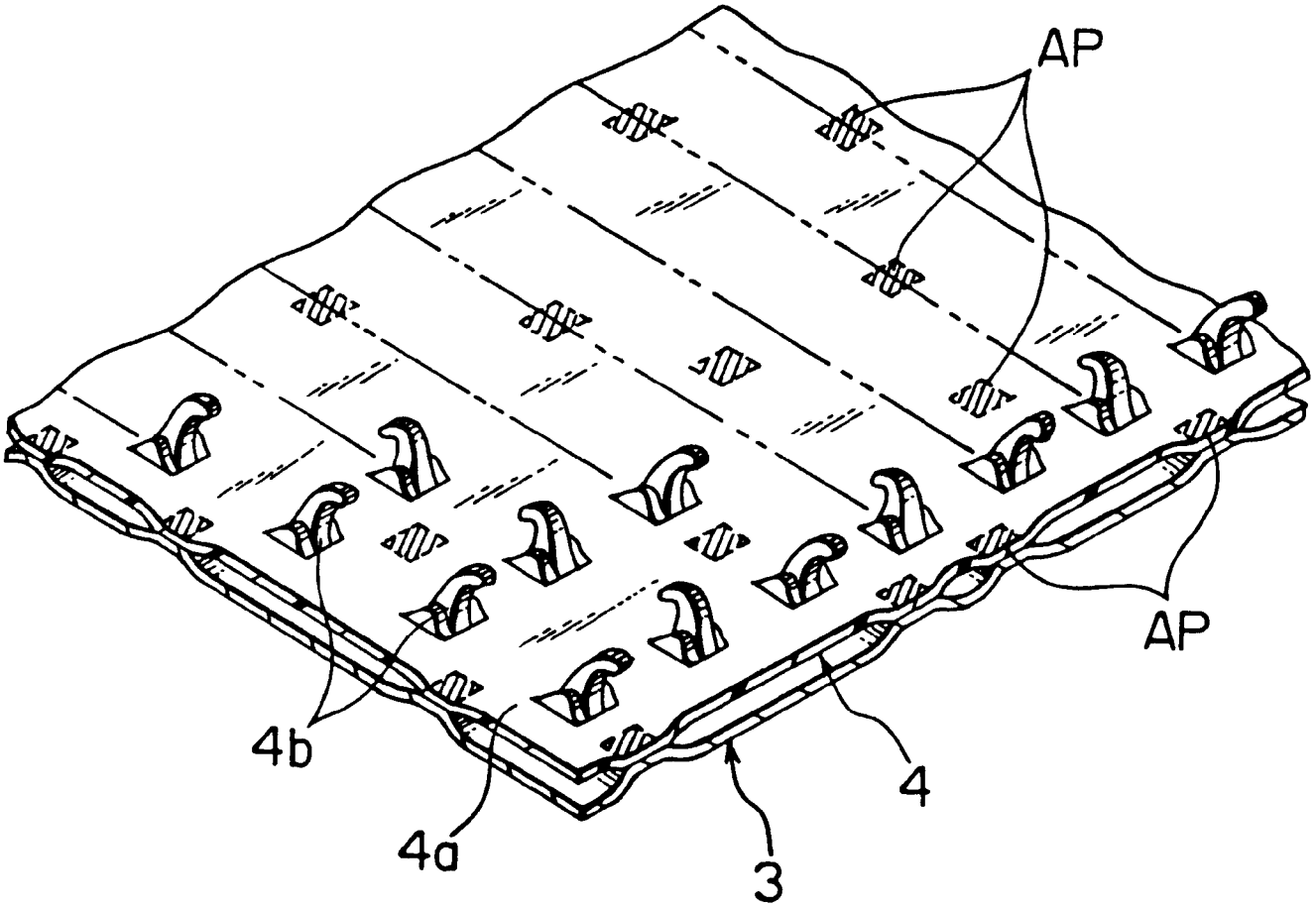
FIG. 1 is a fragmentary front perspective view of a molded surface fastener, with its rear surface supported by a backing sheet, according to a first embodiment of this invention.
Figure 2:
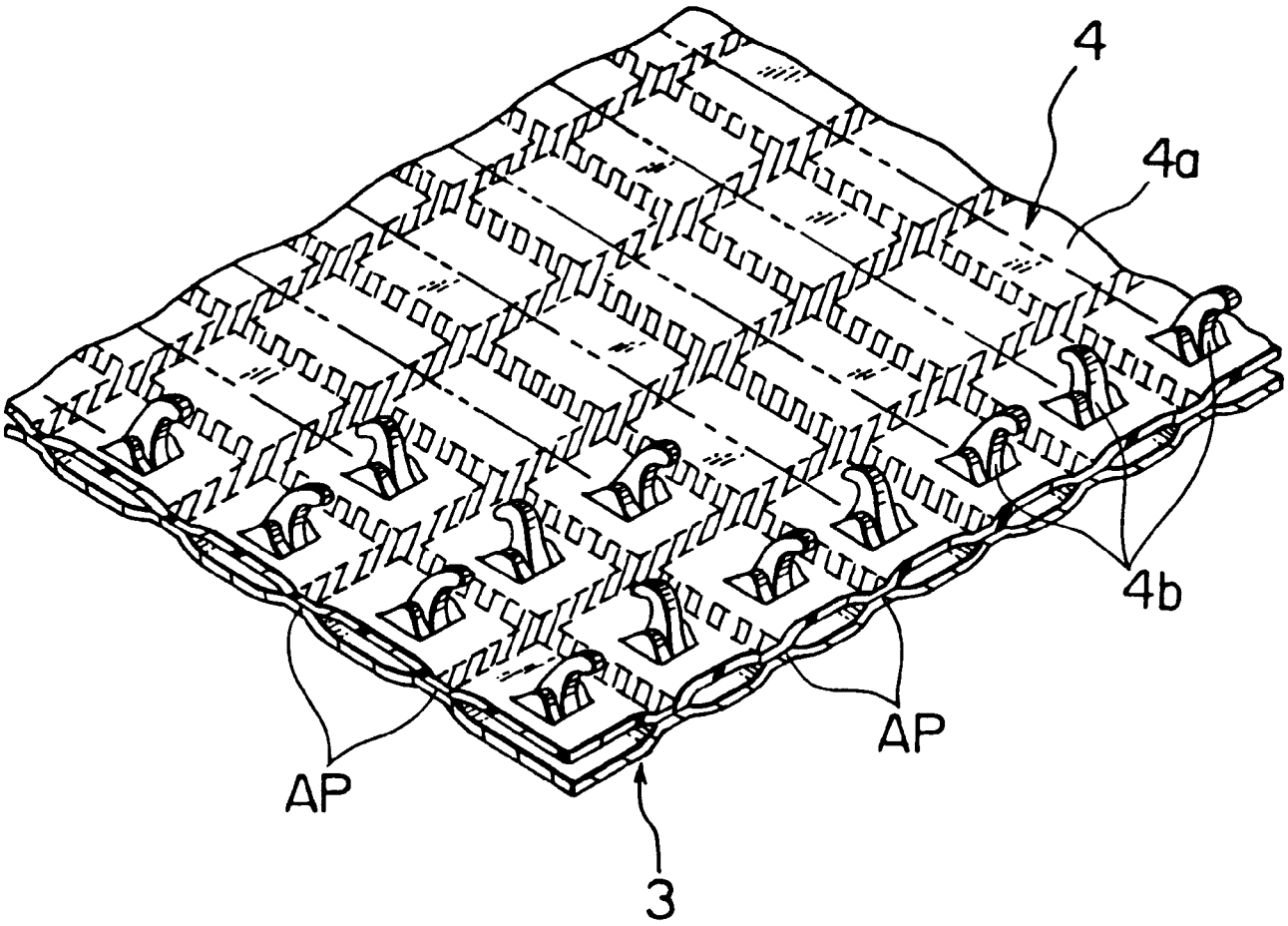
FIG. 2 is a fragmentary front perspective view of a molded surface fastener, with its rear surface supported by a backing sheet, according to a second embodiment of the invention.
Figure 3:
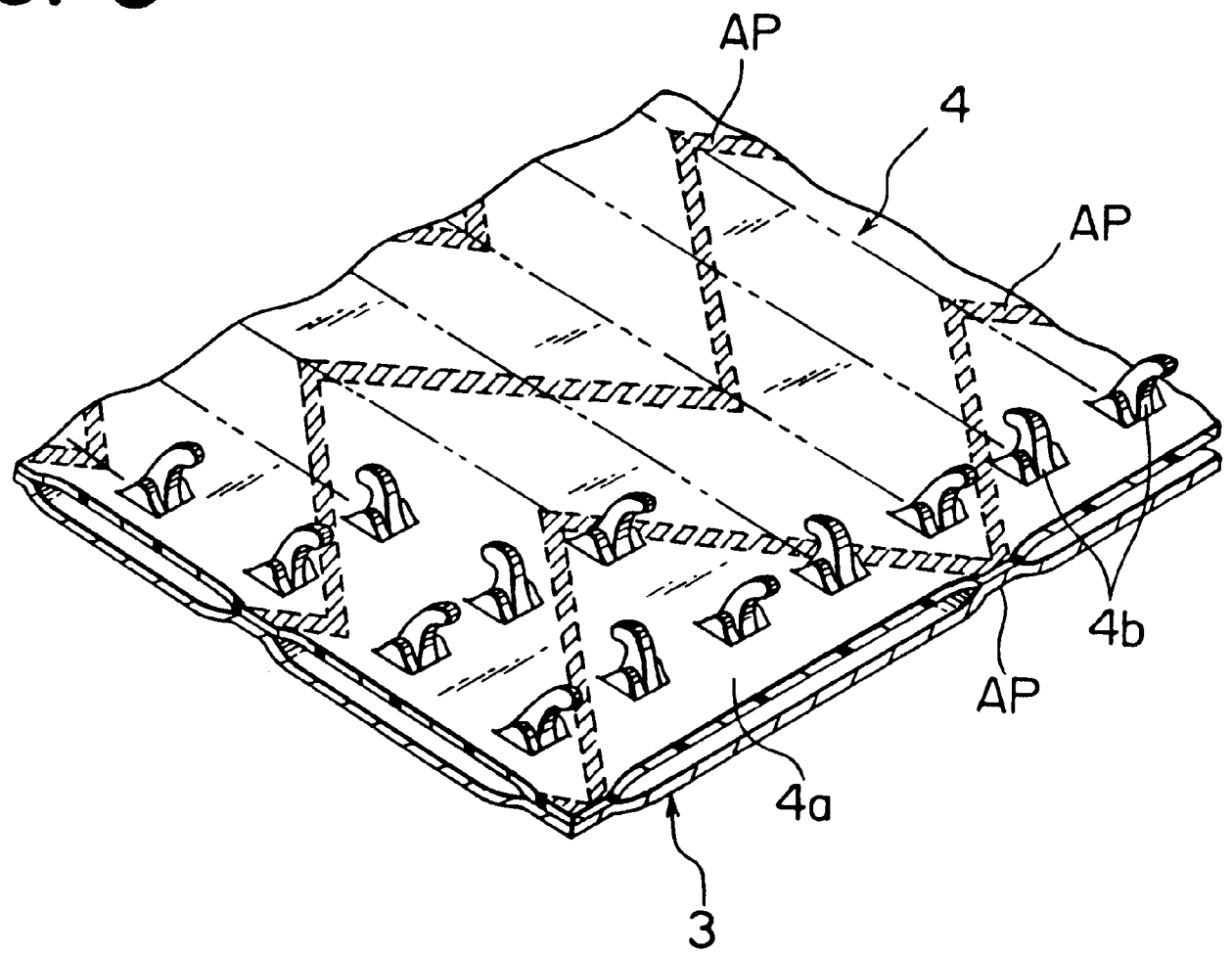
FIG. 3 is a fragmentary front perspective view of a molded surface fastener, with its rear surface supported by a backing sheet, according to a third embodiment.
Figure 4:
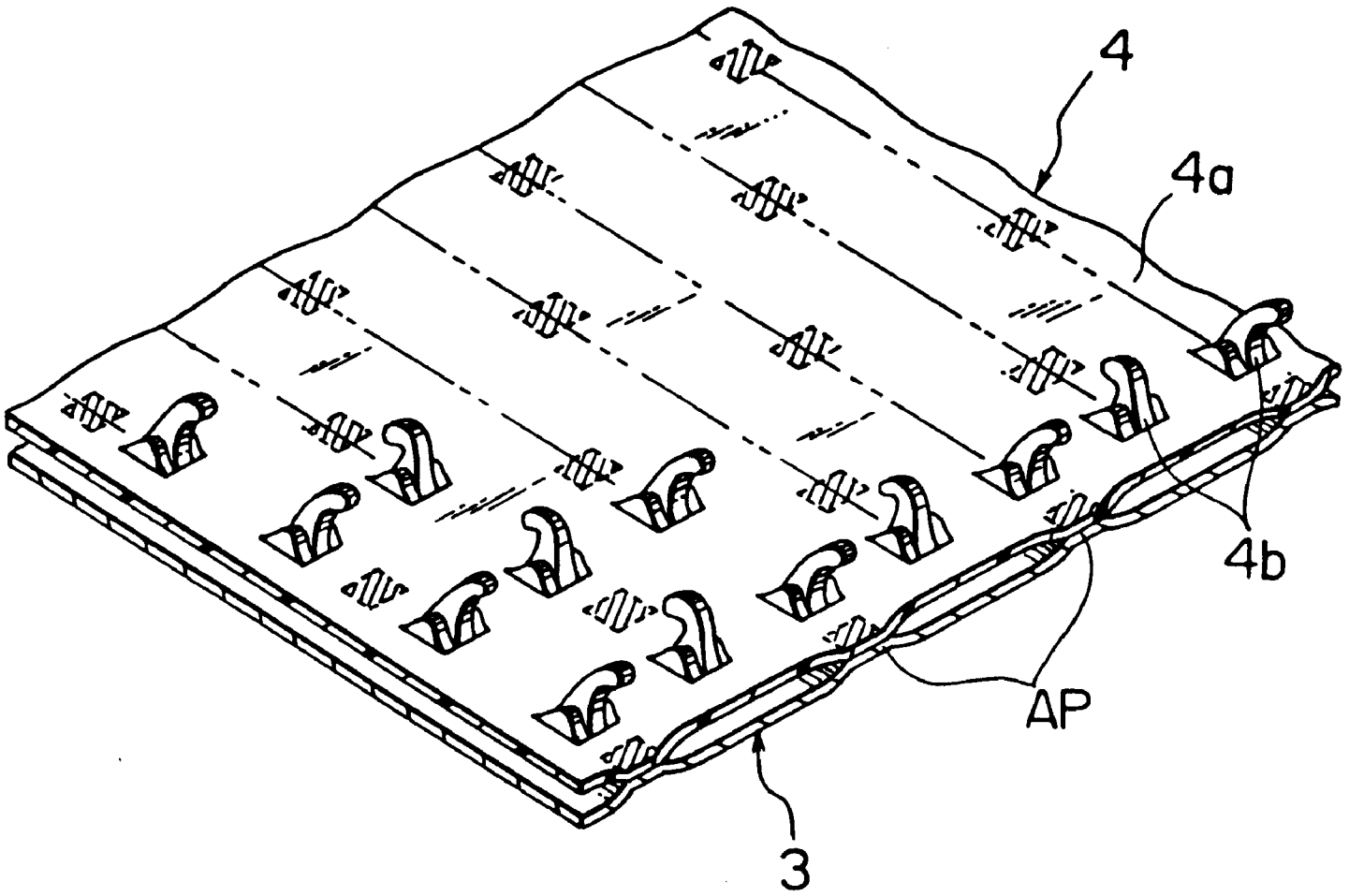
FIG. 4 is a fragmentary front perspective view of a molded surface fastener, with its rear surface supported by a backing sheet, according to a fourth embodiment.
Figure 5:
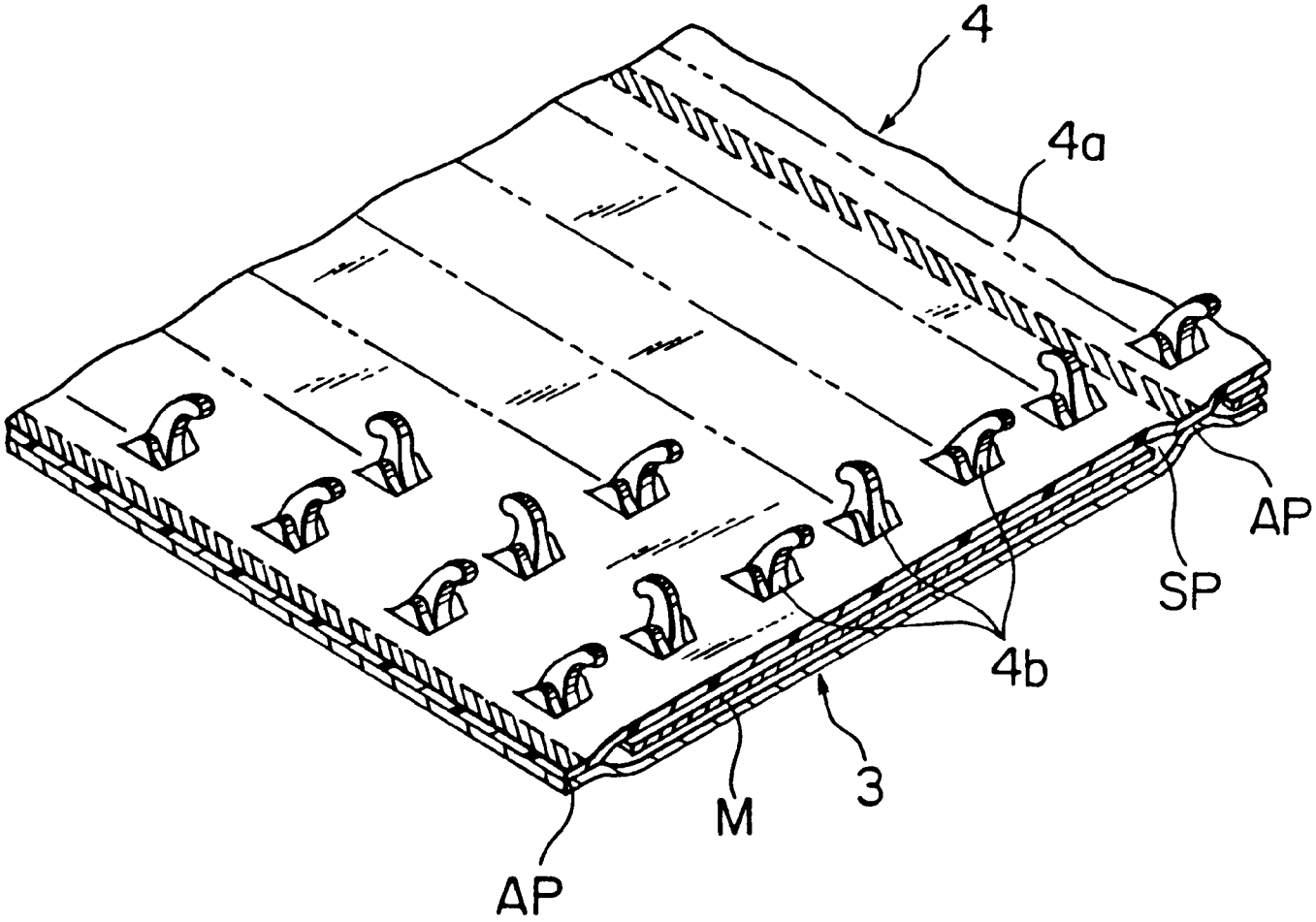
FIG. 5 is a fragmentary front perspective view of a molded surface fastener, with its rear surface supported by a backing sheet, according to a fifth embodiment.

The molded surface fastener of this invention is characterized in that the backing sheet 3 is partly integrally joined with the rear surface of the substrate sheet 4*a* of the molded body 4 by joining regions AP. FIG. 1 shows a first embodiment in which the joining regions AP are a large number of spots arranged at random over the entire rear surface of the substrate sheet 4*a*, FIG. 2 shows a second embodiment in which the joining regions AP are a number of straight lines crossing one another in a checkerboard pattern to form a grid, FIG. 3 is a third embodiment in which the joining regions AP are a number of meandering lines extending in a zigzag pattern, FIG. 4 is a fourth embodiment in which the joining regions AP are arranged in rows in such a manner that those of each pair of adjacent rows are staggered with one another, and FIG. 5 shows a fifth embodiment in which the joining regions AP are two or more parallel straight lines extending on the substrate sheet 4*a* through its entire length or width and spaced a desired distance from one another. Alternatively, the straight joining regions AP may extend at a desired angle with respect to the general longitudinal line of the substrate sheet.

Although the backing sheet 3 may be partly joined with the rear surface of the substrate sheet 4*a* of the molded body 4 by an adhesive agent, it is preferable that the backing sheet 3 is welded with the rear surface of the substrate sheet 4*a* by merging the backing sheet 3 with the rear surface of the substrate sheet 4*a* when the substrate sheet 4*a* is in a semi-molten state and then pressing the backing sheet 3 against the rear surface of the semi-molten substrate sheet 4*a* at the emerging point by a pressing roller rotating in timed relation with the molding rate of the molded body 4. The pressing roller has on its circumferential surface a desired pattern of raised land corresponding to the shape of the joining regions as described below.

According to the molded surface fastener of this invention, since the backing sheet 3 is integrally joined with only part of the rear surface of the substrate sheet 4*a* rather than the entire rear surface of the substrate sheet 4*a*, it is possible to secure adequate flexibility required for surface fasteners and to avoid any crack in the substrate sheet 4*a*, which would have occurred in the conventional molded surface fastener.

In the molded surface fastener, specifically of FIG. 5, at least one thin metal strip or wire M of aluminum or steel is inserted through the space SP defined between the two or more straight joining regions AP so that the molded surface fastener can hold a desired bent or cured posture when it is bent. This alternative molded surface fastener can be tightly attached to a wall having a complex curved surface, thus making it possible to attach an interior ornament or other thing to the wall neatly without locally floating. In another alternative form, at least one magnetic rubber strip may be inserted through the space between the two or more straight joining regions as a substitute for the thin metal strip or wire so that attaching of the molded surface fastener is facilitated particularly when it is used on metal such as a steel post or inside of various kinds of molding dies, which require precise positioning and presecuring.

Figure 6:
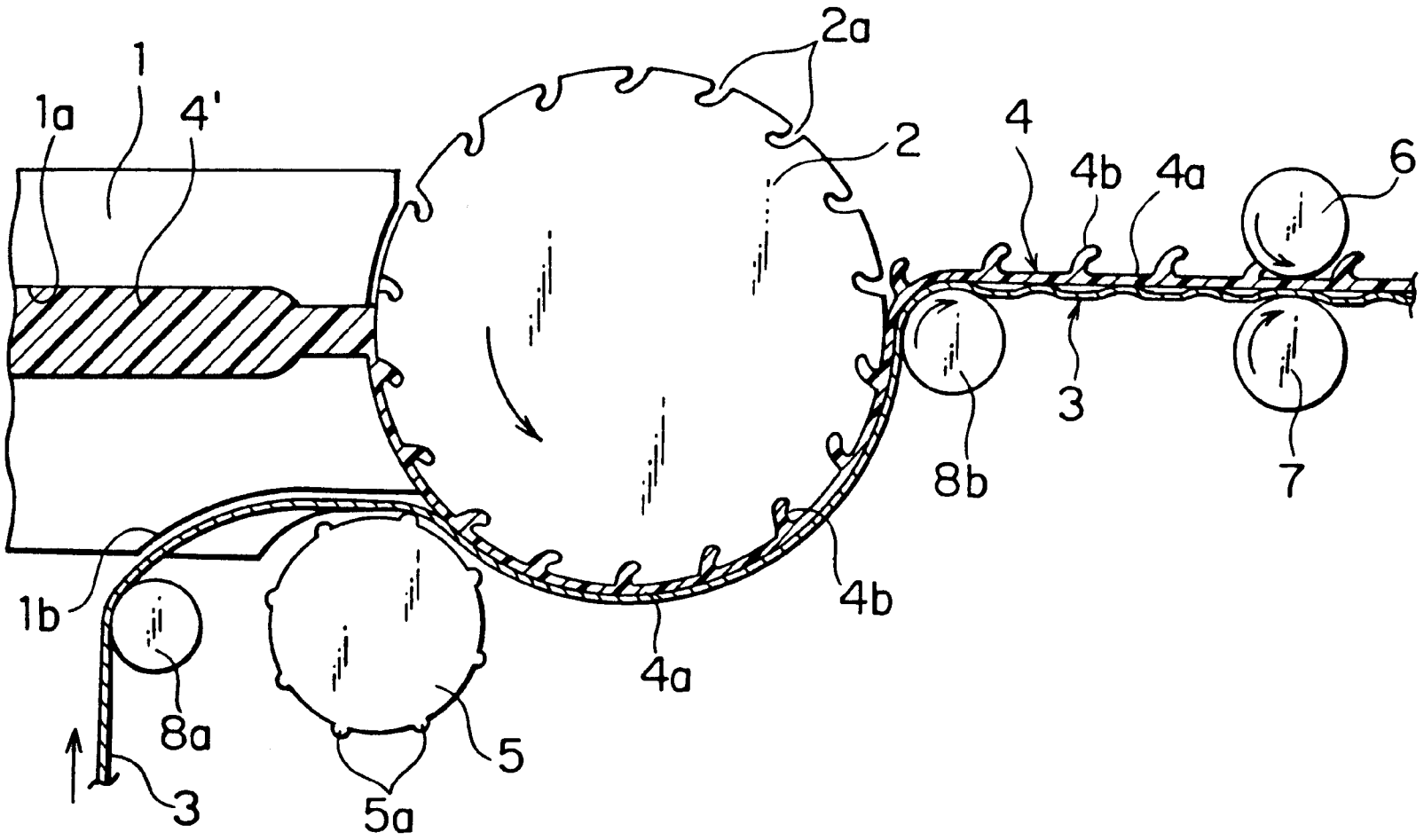
FIG. 6 is a fragmentary vertical cross-sectional view of a first apparatus for carrying out a method of this invention.

FIG. 6 shows a first apparatus for carrying out typical manufacturing method of this invention. In this method, the backing sheet 3 to be joined with the substrate sheet 4*a* is a synthetic resin film, and the engaging element 4*b* standing on the front surface of the substrate sheet 4*a* have a hook shape like the ordinary molded surface fasteners.

In FIG. 6, reference number 1 designates an extrusion nozzle having an arcuate tip surface spaced a predetermined gap from the circumferential surface of a die wheel 2 described below. From an orifice of the extrusion nozzle 1, molten resin 4' is extruded in a sheet form. The orifice of the extrusion nozzle 1 communicates with a single sprue 1*a* extending centrally through the extrusion nozzle 1.

A backing-sheet guide channel 1*b* is formed in the lower half of the extrusion nozzle 1, extending substantially parallel to the sprue 1*a* and terminating in an outlet disposed under the orifice of the extrusion nozzle 1. An entrance of the backing-sheet guide channel 1*b* is in the lower wall of the extrusion nozzle 1. Adjacent to the outlet of the backing-sheet guide channel 1*b*, the pressing roller 5 is disposed with a predetermined gap with respect to the circumferential surface of the die wheel 2. The pressing roller 5 serves to press molten resin 4', which is to be extruded in a sheet form from the nozzle 1, from the front surface of the backing sheet 3 to join the backing sheet 3 with part of the sheet of molten resin 4'.

Figure 7:
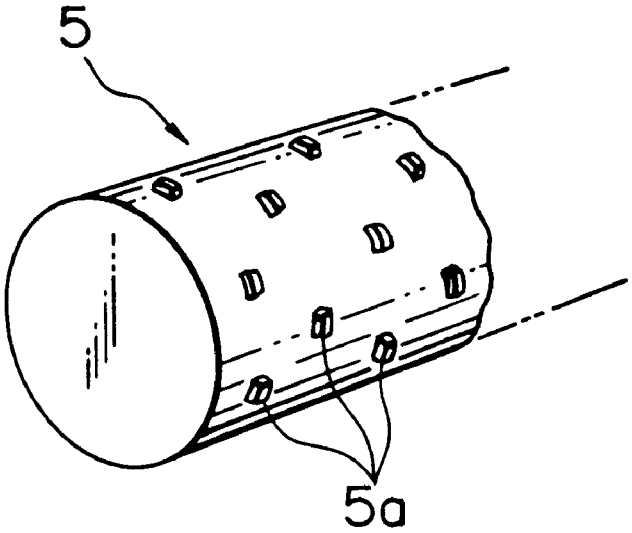
FIG. 7 is a fragmentary perspective view of a typical example of pressing roller to be used in the first apparatus.
Figure 8:
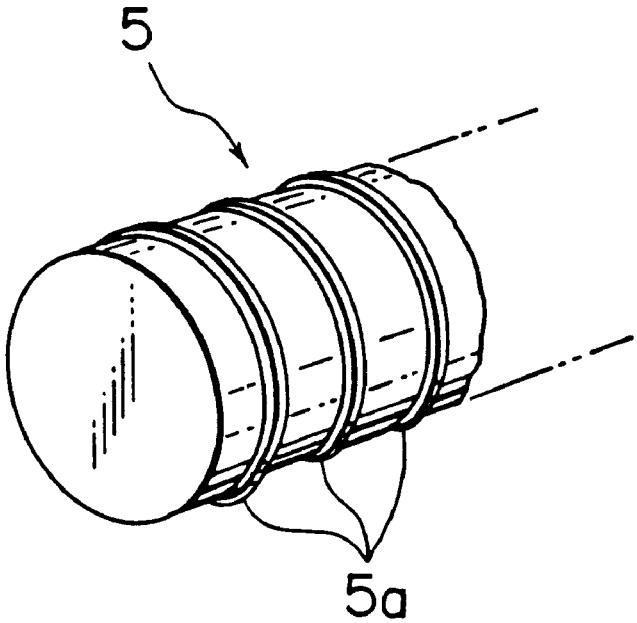
FIG. 8 is a fragmentary perspective view of another typical example of pressing roller to be used in the first apparatus.

For this purpose, the pressing roller 5 has on its circumferential surface a predetermined pattern of raised land 5*a*. In the example of FIG. 7, the raised land 5*a* is in the form of a large number of spots arranged at random on the circumferential surface of the pressing roller 5. In the example of FIG. 8, the raised land 5*a* is in the form of a number of annular ridges extending around the circumferential surface of the pressing roller 5. The whole shape of the raised land 5*a* should by no means be limited to the illustrated examples, it may be a combination of a number of annular ridges extending around the circumferential surface of the pressing roller 5 and a number of straight ridges extending parallel to the axis of the pressing roller 5 or a large number of meandering ridges extending around the circumferential surface of the pressing roller 5. The gap between the top surface of the raised land 5*a* and the circumferential surface of the die wheel 2 is adjusted, by a non-illustrated roller-position adjusting mechanism, to a suitable distance such that the backing sheet 3 is surely joined with substrate sheet 4*a* of the molded body 4.

Since the structure of the die wheel 2 is substantially identical with that disclosed in International Patent Publication No. Hei 1-501775 (on International Patent Application filed in Japan), it will now be described here only briefly. The die wheel 2 is composed of a large number of die rings placed one over another to form a hollow drum having a cooling water jacket inside. Each die ring has a multiplicity of hook-element-forming cavities 2*a* on opposite side peripheral surfaces, each cavity opening at its root end to the side peripheral surface. Each die ring is sandwiched between adjacent spacer rings which are flat at opposite side surfaces. The die wheel 2 is driven by a non-illustrated known drive unit for rotation in the direction of an arrow in FIG. 6. Downstream (right in FIG. 6) of the die wheel 2, a guide roller 8*b* is disposed for rotation at a peripheral speed equal to that of the die wheel 2. Further downstream of the guide roller 8*b*, a set of upper and lower feed rollers 6, 7 is disposed.

The material of the molded body 4 and the material of the backing sheet 3 are already listed above. The molded body 4 and the backing sheet 3 may be identical with and different from each other in material. In molding, considering the kind of the material used, a molten resin temperature, an extrusion resin pressure, a die wheel temperature, a rotating speed of the die wheel, etc. are suitably adjusted. In the illustrated example, since the backing-sheet guide channel 1*b* is formed in the extrusion nozzle 1, it is preferable that the synthetic resin materials are selected such that the melting point of the molded body 4 is lower than that of the backing sheet 3.

In operation, as molten resin 4' extruded from the extrusion nozzle 1 is introduced to the gap defined between the extrusion nozzle 1 and the rotating die wheel 2, part of the extruded molten resin 4' is filled the successive hook-element-forming cavities 2*a* of the die wheel 2 to mold a multiplicity of hook elements 4*b* and the remaining part of the extruded molten resin 4' is continuously molded into a substrate sheet 4*a* having a predetermined width and a predetermined thickness.

Simultaneously with this molding, the backing sheet 3 is supplied toward the die wheel 2 through the backing-sheet guide channel 1*b*, during which the backing sheet 3 is heated by the extrusion nozzle 1, as guide by a guide roller 8*a*. Immediately off the outlet of the backing-sheet guide channel 1*b*, the backing sheet 3 is pressed against the rear surface (outer side) of the substrate sheet 4*a* still in semi-molten state by the pressing roller 5. At that time, the raised land 5*a* on the circumferential surface of the pressing roller 5 pushes the backing sheet 3 against the rear surface of the substrate sheet 4*a* at only a limited region corresponding to the shape of the raised land 5*a*.

While the semi-molten body 4 and the backing sheet 3 revolve a substantially semicircular trip along with the circumferential surface of the die wheel 2, they become solidified as a unit as cooled from inside of the die wheel 2. Upon termination of this solidifying, the molded substrate sheet 4*a* is drawn together with the backing sheet 3 in the direction of extrusion by a suitable pulling force so that the individual hook elements 4*b* molded in the cavities 2*a* of the die wheel 2 are smoothly removed as they elastically deform into a straight form and then soon restore its original shape.

In the first apparatus of FIG. 6, after molding, the molded surface fastener with the backing sheet 3 is drawn by the upper and lower feed rollers 6, 7 which rotate opposite directions in synchronism with each other. Although the circumferential surfaces of the feed rollers 6, 7 may be flat, it is preferable that they have a large number of annular grooves for the corresponding rows of molded hook elements 4*b* to pass without damage.

Figure 9:
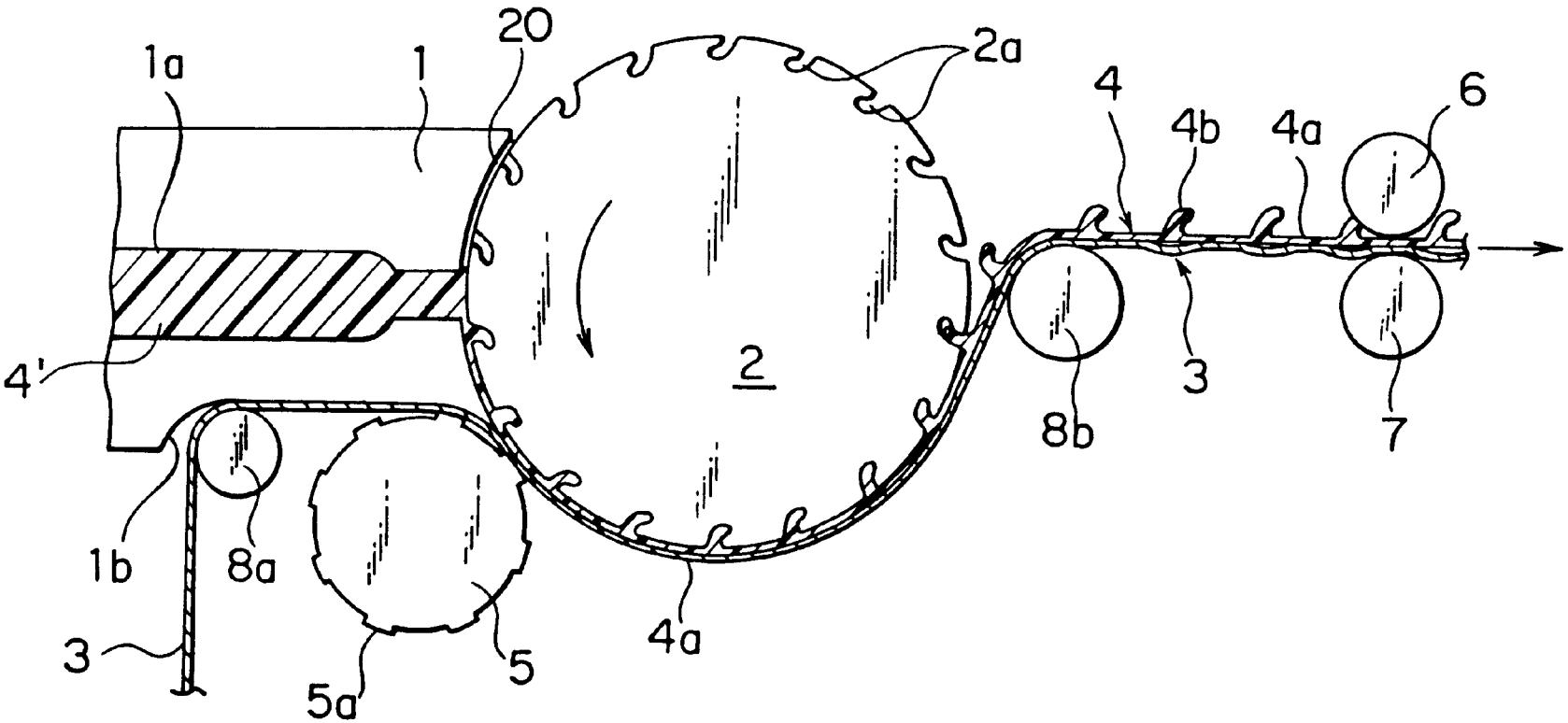
FIG. 9 is a fragmentary vertical cross-sectional view of a second apparatus for carrying out the method of this invention.

FIG. 9 shows a second apparatus for carrying out the method of this invention which apparatus is similar to the first apparatus except that the backing-sheet guide channel 1*b* is formed outside of the extrusion nozzle 1. In FIG. 9, parts or elements substantially similar to those of the FIG. 6 are designate same reference numbers. In the second apparatus, the backing sheet 3 is a usual woven or knit fabric or a non-woven cloth, joining between the backing sheet 3 and the molded body 4 after molding is firm likewise in the first apparatus. According to the second apparatus, as molten resin 4' extruded from the extrusion nozzle 1 is introduced to the gap 20 defined between the extrusion nozzle 1 and the rotating die wheel 2, part of the extruded molten resin 4' is filled the successive hook-element-forming cavities 2*a* of the die wheel 2 to mold a multiplicity of hook elements 4*b* and the remaining part of the extruded molten resin 4' is continuously molded into a substrate sheet 4*a*. Simultaneously with this molding, the backing sheet 3 is supplied toward the die wheel 2 through the backing-sheet guide channel 1*b*, which is at the lower wall of the extrusion nozzle 1, during which the backing sheet 3 is heated by the extrusion nozzle 1, as guided by the guide roller 8*a*. Immediately off the outlet of the backing-sheet guide channel 1*b*, the backing sheet 3 is pressed against the rear surface (outer side) of the substrate sheet 4*a* still in semi-molten state by the pressing roller 5. As a result, the backing sheet 3 and the substrate sheet 4*a* are joined together at only a predetermined pattern of joining region.

During this pressing, part of the molten resin 4' of the substrate sheet 4*a* penetrates into spaces between fibers of the backing sheet 3, reaching to the deep inside the backing sheet 3 if there is only a small difference in temperature between the molten resin of the substrate sheet 4*a* and the backing sheet 3, thus joining the substrate sheet 4*a* and the backing sheet 3 together firmly. Then the backing sheet 3 and the molded body 4 are cooled quickly from both inside and outside of the die wheel 2 to become solidified, whereupon the molded body 4 is drawn together with the backing sheet 3 by the upper and lower feed rollers 6, 7 as guided by the second guide roller 8*b*.

Figure 10:
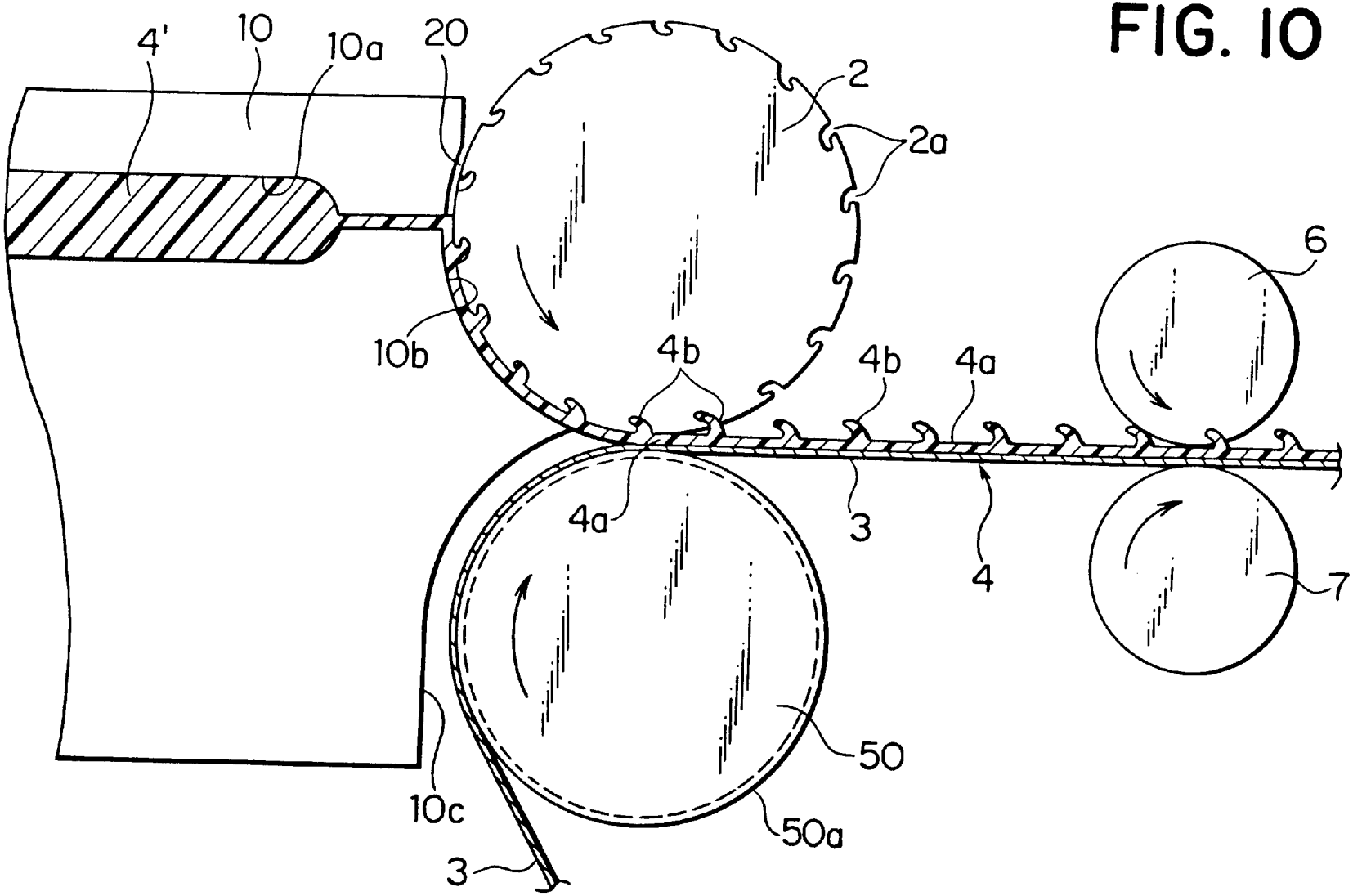
FIG. 10 is a fragmentary vertical cross-sectional view of a third apparatus for carrying out the method of this invention.

FIG. 10 shows a third apparatus for carrying out the method of this invention. In the third apparatus, a backing-sheet pressing wheel 50 having an outer diameter substantially equal to that of the die wheel 2 is disposed under the die wheel 2. The two wheels 2, 50 are disposed close to upper and lower concave surfaces 10*b*, 10*c* of the tip of an extrusion nozzle 10 and are driven for rotation in opposite directions in synchronism with each other. The lower concave surface 10*c* defines part of the backing-sheet guide channel.

In the third apparatus, while molten resin 4' is extruded in a sheet form from the extrusion nozzle 10 through a sprue 10*a* to the die wheel 2 likewise in the foregoing apparatus, the backing sheet 3 is introduced to the backing-sheet pressing wheel 50 from lower side as it takes a substantially ⅓ trip on the circumferential surface of the baking-sheet pressing wheel 50 along the backing-sheet guide channel, which is defined between the extrusion nozzle 10 and the backing-sheet pressing wheel 50. At that time, the backing sheet 3 is heated by the heat of the extrusion nozzle 10. With continued rotation of the two wheels 2, 50, the backing sheet 3 and the substrate sheet 4*a* merge with each other between the two wheels 2, 50 and are compressed there under the pressure of the lower wheel 50. As a result, the backing sheet 3 and the substrate sheet 4*a* are integrally joined with each other at only a predetermined pattern of Joining region, whereupon the resulting molded surface fastener is positively drawn by the upper and lower feed rollers 6, 7. In the third apparatus, the backing-sheet pressing wheel 50 serves as the pressing means of this invention.

In this apparatus, the backing-sheet pressing wheel 50, like the pressing roller 5, has on its circumferential surface an arbitrary pattern of raised land 50*a*. As the backing sheet 3 is pressed against the rear surface of the semi-molten substrate sheet 4*a* by the baking-sheet pressing wheel 50, the backing sheet 3 and the substrate sheet 4*a* are integrally Joined together at only a limited region AP corresponding to the shape of the raised land 50*a* as shown in FIGS. 1 through 5.

The molded body 4 molded by each of the first, second and third apparatuses is composed of a substrate sheet 4*a* and a multiplicity of hook elements 4*b* molded integrally on the front surface of the substrate sheet 4*a*. A backing sheet 3 is integrally joined with the rear surface of the substrate sheet 4*a* at only a pattern of joining region. Though there is no illustration in the drawings, the hook elements 4*b* are formed on the substrate sheet 4*a* in a large number of parallel rows; the hook elements 4*b* in the same row face in a common direction, while those in adjacent rows face in opposite directions. With this arrangement, a surface fastener having no directivity in engaging force can be achieved.

In the illustrated embodiments, the engaging elements 4*b* formed on the front surface of the substrate sheet 4*a* have a hook shape. In this invention, the engaging elements 4*b* are not limited to a hook shape and may have any other shape such as a mushroom shape or a substantially V shape. Further, the stem of the individual hook element may be reinforced by increasing the thickness. This invention should by no means be limited to the illustrated examples, and various modifications may be suggested without departing from the principles of this invention. As is apparent from the foregoing detailed description, according to the molded surface fastener of this invention, since the backing sheet is integrally joined with part of the rear surface of the synthetic resin molded substrate sheet rather than with the entire rear surface, it is possible to secure adequate flexibility and also to avoid any crack in the substrate sheet, which would have occurred with the conventional molded surface fastener.

In an alternative form, at least one metallic thin strip or wire may be inserted through the space defined between two or more straight lines of joining regions so that the molded surface fastener can hold a desired bent or cured posture when it is bent. This alternative molded surface fastener can be tightly attached to a wall having a complex curved surface, thus making it possible to attach an interior ornament or other thing to the wall neatly without locally floating. In another alternative form, at least one magnetic rubber strip may be inserted through the space between the two or more straight joining regions as a substitute for the thin metal strip or wire so that attaching of the molded surface fastener is facilitated particularly when it is used on a steel post or inside various kinds of molding dies, which require precise positioning and presecuring.

This molded surface fastener with the backing sheet can be continuously manufactured in a simple one-step process on the conventional molding apparatus.

What is claimed is:

1. A molded surface fastener comprising:

(a) a synthetic resin molded substrate sheet having a front surface and a rear surface, the front surface having a multiplicity of engaging elements molded thereon; and (b) a backing sheet having a front surface and a rear surface, the front surface of the backing sheet being partially integrally joined with said rear surface of said substrate sheet at a plurality of joining spot regions arranged over said rear surface of said substrate sheet and said front surface of said backing sheet, the rear surface of the substrate sheet and the front surface of the backing sheet each having unattached portions disposed between said joining spot regions, the unattached portions of the substrate sheet and the unattached portions of the backing sheet curving outwardly away from each other to form outwardly protruding lands on said substrate sheet and said backing sheet between said joining spot regions, the plurality of joining spot regions of said substrate sheet and said bonding sheet curving inwardly towards each other to form roots disposed between said lands.

2. A molded surface fastener according to claim 1, wherein said backing sheet and said substrate sheet are integrally joined together by a grid-like joining region arranged over said rear surface of said substrate sheet.

3. A molded surface fastener according to claim 1, wherein said backing sheet and said substrate sheet are integrally joined together by at least one straight line of joining region extending on said rear surface of said substrate sheet through the entire length or width of said substrate sheet.

4. A molded surface fastener according to 3, further comprising at least one thin metal strip or wire inserted through at least one space defined between said two or more straight lines of joining regions.

5. A molded surface fastener according to claim 3, further comprising at least one magnetic rubber strip inserted through at least one space defined between said two or more straight lines of joining regions.

6. A molded surface fastener according to claim 1, wherein said backing sheet and said substrate sheet are integrally joined together by at least one meandering line of joining region extending on said rear surface of said substrate sheet through the entire length or width of said substrate sheet.

7. A molded surface fastener according to claim 1, wherein said joining spot regions are arranged in rows in such a manner that said joining spot regions of each pair of adjacent rows are staggered with one another.

* * * * *